US009524627B2

(12) United States Patent
Kim

(10) Patent No.: US 9,524,627 B2
(45) Date of Patent: Dec. 20, 2016

(54) WALLET FOR CARRIER

(71) Applicant: Dae Soo Kim, Goyang-si (KR)

(72) Inventor: Dae Soo Kim, Goyang-si (KR)

( * ) Notice: Subject to any disclaimer, the term of this patent is extended or adjusted under 35 U.S.C. 154(b) by 0 days.

(21) Appl. No.: 14/806,935

(22) Filed: Jul. 23, 2015

(65) Prior Publication Data

US 2016/0063829 A1 Mar. 3, 2016

(30) Foreign Application Priority Data

Sep. 2, 2014 (KR) ..... 20-2014-0006484 U

(51) Int. Cl.
*G08B 21/00* (2006.01)
*G08B 13/14* (2006.01)

(52) U.S. Cl.
CPC ..... *G08B 13/1427* (2013.01)

(58) Field of Classification Search
CPC . G08B 13/14; G08B 13/1427; G08B 13/1445; G08B 21/0247
USPC ..... 340/686.6, 568.7, 571
See application file for complete search history.

(56) References Cited

U.S. PATENT DOCUMENTS 5,781,109 A * 7/1998 Nakajima ..... G08B 13/1427 340/539.1
2009/0040048 A1* 2/2009 Locker ..... G08B 21/24 340/572.1
2009/0077675 A1* 3/2009 Cabouli ..... A45C 1/06 726/34
2011/0315284 A1* 12/2011 Hause ..... A45C 3/06 340/384.1

FOREIGN PATENT DOCUMENTS

JP 06-052544 U 7/1994
JP 3161850 U 8/2010
KR 10-2004-0101099 A 12/2004
KR 10-2009-0069733 A 7/2009

OTHER PUBLICATIONS

Korean Office Action issued in KR 20-2014-0006484 dated Nov. 17, 2014.

* cited by examiner

*Primary Examiner* — Thomas Mullen
(74) *Attorney, Agent, or Firm* — Sughrue Mion, PLLC

(57) ABSTRACT

A wallet for a carrier includes a receiving body formed to be folded along a direction of a length thereof and having a plurality of receiving parts at a side surface thereof, a fixing part attached to the receiving body to hold the receiving body in a folded position, and a coupling part attached to a side of the receiving body and having a coupling member fixed thereto, the coupling member coupled to a target for coupling.

4 Claims, 9 Drawing Sheets

WALLET FOR CARRIER

CROSS-REFERENCE TO RELATED APPLICATIONS

This patent application claims priority under 35 U.S.C. §119 to Korean Utility Model Application No. 20-2014-0006484, filed on Sep. 2, 2014, in the Korean Intellectual Property Office, the disclosure of which is incorporated by reference herein in its entirety.

TECHNICAL FIELD

Embodiments of the present invention concern wallets for carrier that may easily receive items while the carrier is on the move while preventing it from being stolen.

DISCUSSION OF RELATED ART

Population attending long-flight travel is steadily on the rise, and thus, there is more demand for carry-on baggage for easier storage and transport of accompanying items.

Travelers oftentimes carry their small stuff, such as passports, IDs, or credit cards, in their pockets and frequently need to show them while going through the entry or departure procedure. When carried by the travelers, the items may be prone to be lost or stolen.

SUMMARY

According to an embodiment of the present invention, a wallet for a carrier comprises a receiving body formed to be folded along a direction of a length thereof and having a plurality of receiving parts at a side surface thereof, a fixing part attached to the receiving body to hold the receiving body in a folded position, and a coupling part attached to a side of the receiving body and having a coupling member fixed thereto, the coupling member coupled to a target for coupling. The coupling part may comprises an insertion hole formed through the receiving body, the coupling member inserted through the insertion hole, a projecting pad attached to a side surface of the receiving body, an end of the coupling member passing through the insertion hole and fixed to the projecting pad, and a coupling pad attached to another side surface of the receiving body, a hanging hook connected to the coupling pad.

The fixing part may be a coupling button fixing the folded position of the receiving body.

A covering member may be attached to the receiving body to cover a side surface of the folded receiving body.

An alarming device may be installed in the receiving body to generate an alarm when the carrier wallet is separated from the target for coupling at a predetermined distance or more. The alarming device may comprise a first sensor attached to the target for coupling, a second sensor installed in the receiving body to sense being separated from the first sensor at a predetermined distance or more, and an alarming unit generating an alarm when the second sensor is separated from the first sensor at the predetermined distance or more.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Hereinafter, exemplary embodiments of the inventive concept will be described in detail with reference to the accompanying drawings. The inventive concept, however, may be modified in various different ways, and should not be construed as limited to the embodiments set forth herein. Like reference denotations may be used to refer to like or similar elements throughout the specification and the drawings. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

Figure 1:
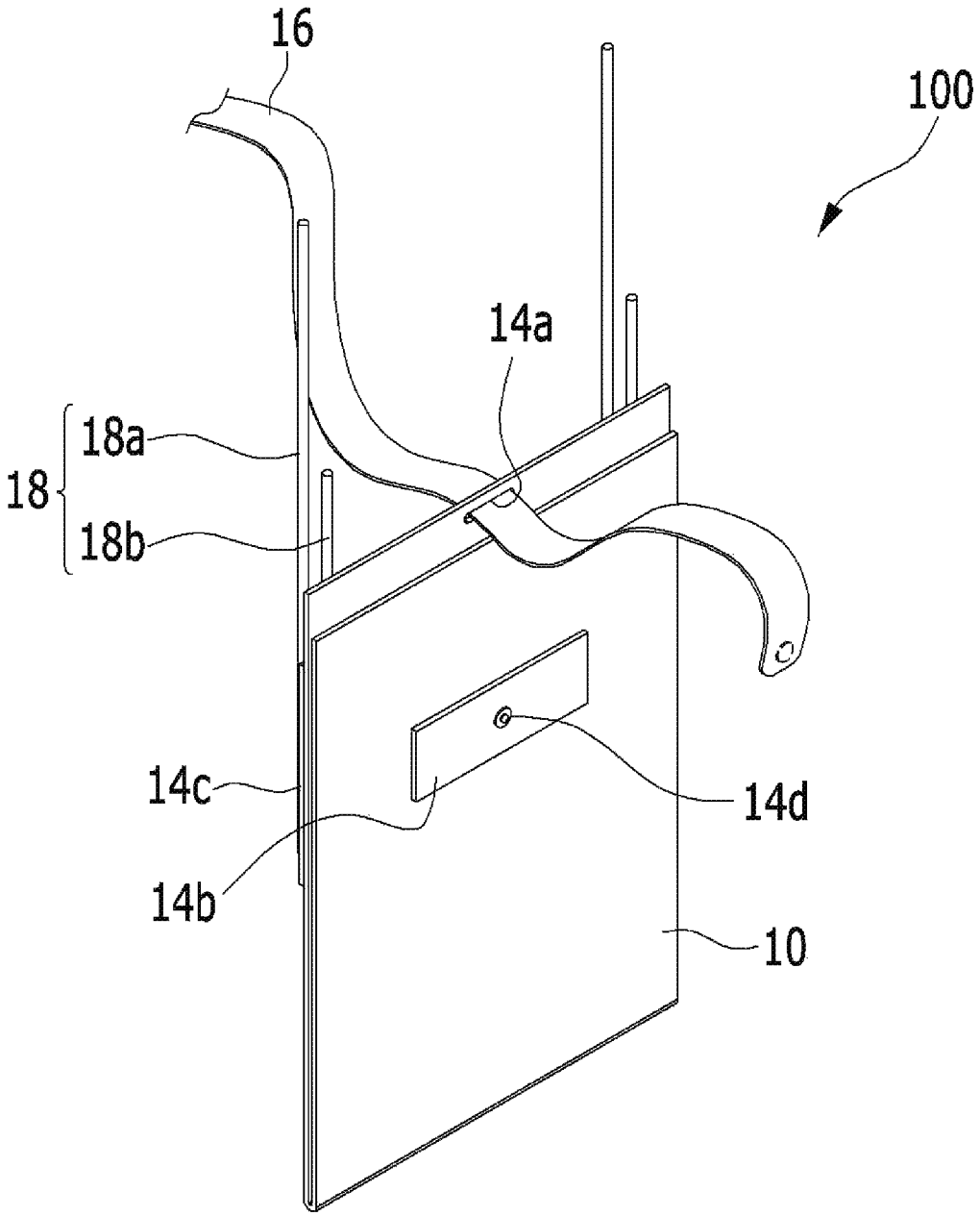
FIG. 1 is a perspective view illustrating a wallet for a carrier according to an embodiment of the present invention.
Figure 2:
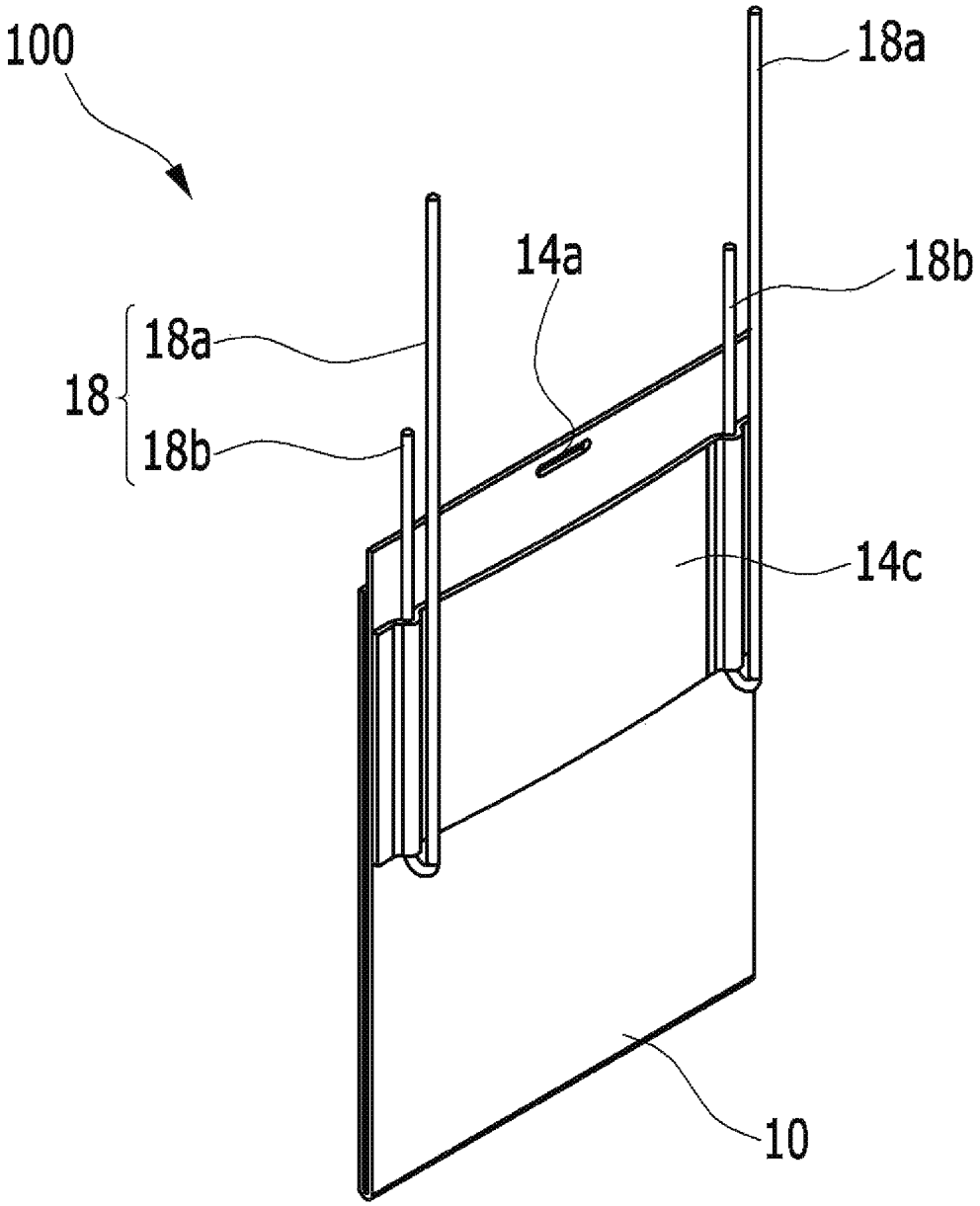
FIG. 2 is a perspective view illustrating the wallet for a carrier of FIG. 1 as viewed in another direction according to an embodiment of the present invention.
Figure 3:
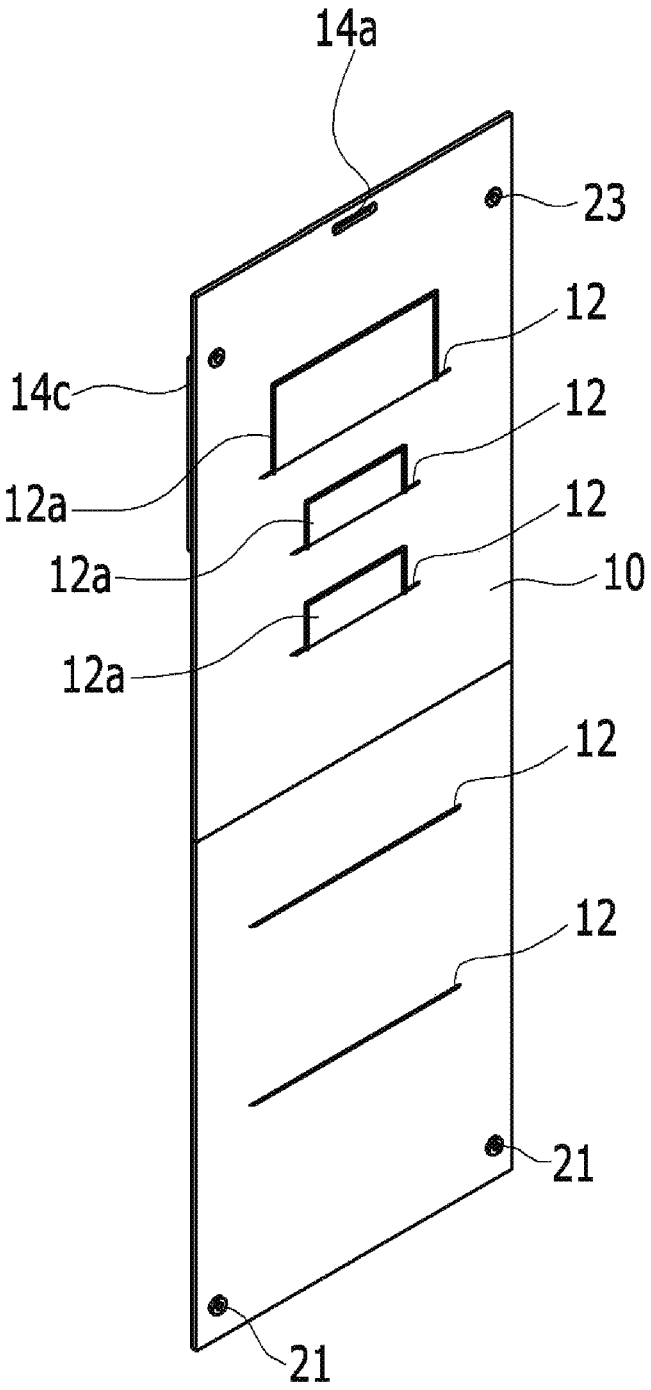
FIG. 3 is a perspective view illustrating the wallet for a carrier of FIG. 1 that is opened, according to an embodiment of the present invention.
Figure 4:
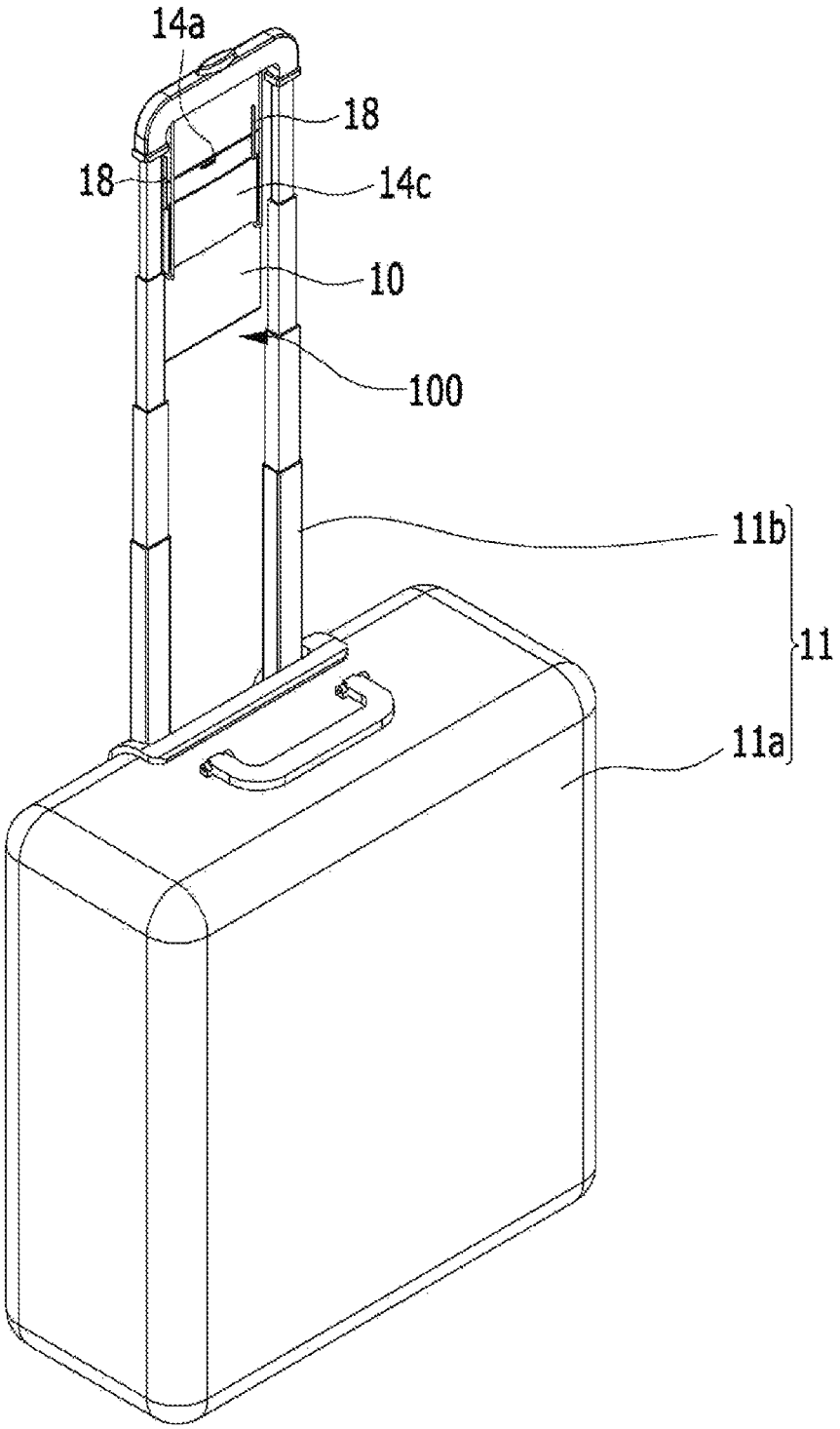
FIG. 4 is a perspective view illustrating the wallet for a carrier of FIG. 1 that is fastened to a handle of the carrier according to an embodiment of the present invention.
Figure 5:
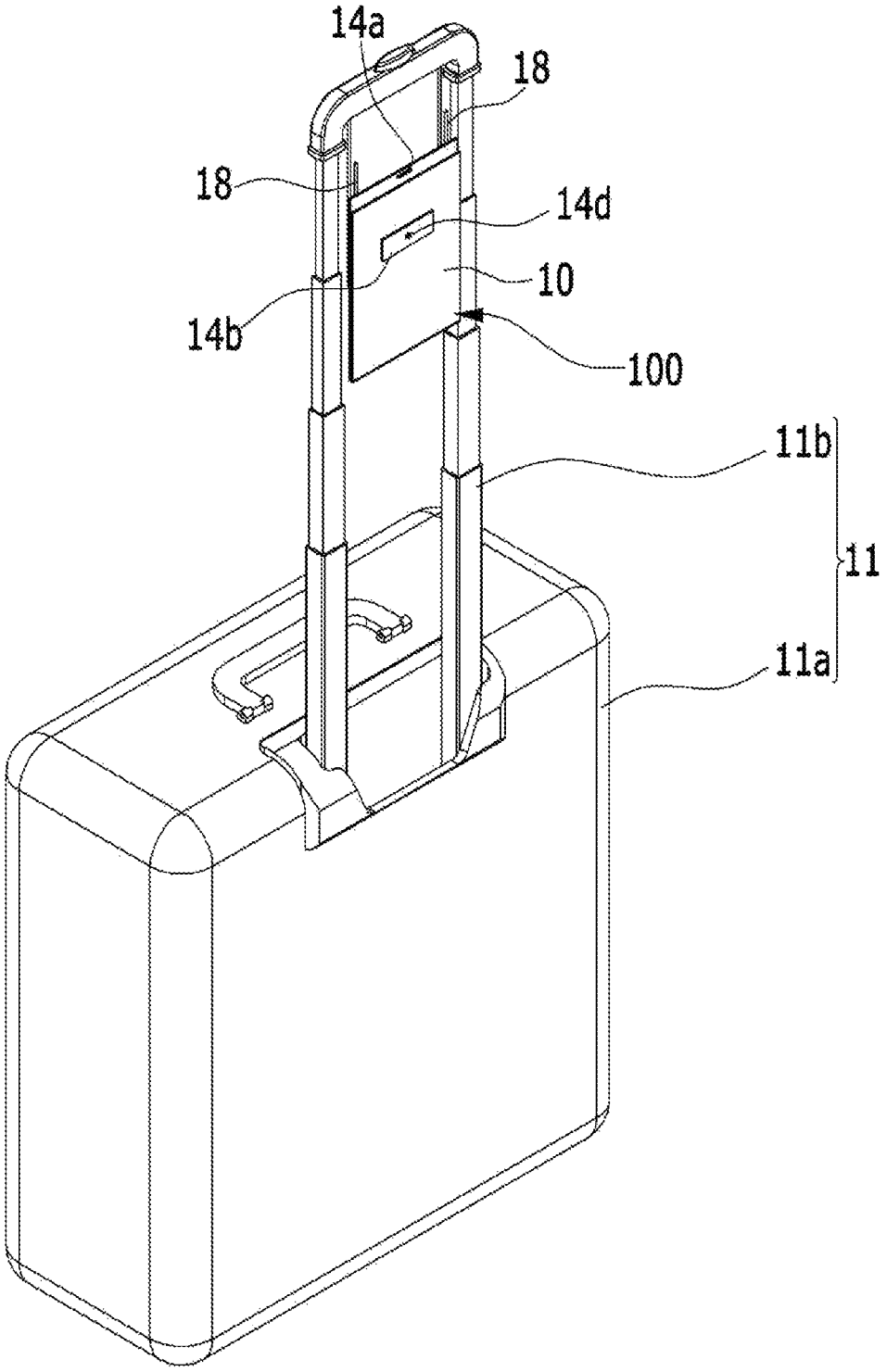
FIG. 5 is a perspective view illustrating the wallet for a carrier of FIG. 4 that is fastened to the handle of the carrier as viewed in another direction, according to an embodiment of the present invention.

FIG. 1 is a perspective view illustrating a wallet for a carrier according to an embodiment of the present invention. FIG. 2 is a perspective view illustrating the wallet for a carrier of FIG. 1 as viewed in another direction according to an embodiment of the present invention. FIG. 3 is a perspective view illustrating the wallet for a carrier of FIG. 1 that is opened, according to an embodiment of the present invention. FIG. 4 is a perspective view illustrating the wallet for a carrier of FIG. 1 that is fastened to a handle of the carrier according to an embodiment of the present invention. FIG. 5 is a perspective view illustrating the wallet for a carrier of FIG. 4 that is fastened to the handle of the carrier as viewed in another direction, according to an embodiment of the present invention.

As used herein, the term "wallet for a carrier" or "carrier wallet" may refer to any receiving means including, but not limited to, a pouch, a wallet, or a bag that may be detachably coupled to a carrier for receiving an item and may be moved together with the carrier while the user is on the move. In other words, although a wallet 100 for a carrier 11 is described for ease of description, embodiments of the present invention are not limited thereto and may rather apply to any receiving means including, but not limited to, a pouch, a wallet, or a bag that may be detachably coupled to the carrier to be moved along with the carrier and that may receive articles, things, or items.

As used herein, the term "wallet for a carrier" may be interchangeably used with the term "carrier wallet" merely for ease of description.

As used herein, the term "carrier" may refer to various types of a bag, case, baggage or luggage that may be carried, pulled, or pushed by a hand, but embodiments of the present invention are not limited thereto.

The carrier 11 includes a carrier body 11*a* for receiving items and a handle 11*b* withdrawably provided in the carrier body 11*a*. According to an embodiment of the present invention, the carrier wallet 100 may be detachably provided to the handle 11*b* of the carrier.

Referring to FIGS. 1 to 5, the carrier wallet 100 is formed to be folded along a direction of a length thereof. The carrier wallet 100 includes a receiving body 10, a coupling part (including an insertion hole 14*a*, a projecting pad 14*b*, a coupling pad 14*c*, and a fixing button 14*d*), and a fixing part 20. The receiving body 10 may include a plurality of receiving parts 12. The coupling part is attached to a side of the receiving body 10. A coupling member is fixed to the coupling part. The coupling member is coupled to a target (e.g., the carrier 11) to which the coupling member is supposed to be coupled. The fixing part 20 is attached to the receiving body 10 to fix or maintain the folded position of the receiving body 10.

The receiving body 10 is formed to be folded along a direction of a length thereof. The receiving body 10 may be detachably provided to the carrier 11. For example, the receiving body 10 may be folded substantially in half along the lengthwise direction and may be fixed to the fixing part 20. Accordingly, the receiving body 10 may be folded by the user's selection.

The receiving body 10 may be formed of leather so that the receiving body 10 may be easily bent or folded by the user's selection. The whole receiving body 10 may be formed of leather, or alternatively, a portion of an outer surface of the receiving body 10 may be formed of leather. The receiving body 10 may have a plurality of receiving parts 12.

At least two or more receiving parts 12 may be included in an inside surface of the receiving body 10. For example, the receiving parts 12 may include openings formed by cutting an outer surface of the receiving body 10, so that items 12*a* may be received through the openings in the receiving parts 12. The items 12*a* may include, e.g., the user's identity (ID) card, passport, or credit card. Although, as an example, the receiving parts 12 are formed integrally with the receiving body 10, embodiments of the present invention are not limited thereto. Alternatively, the receiving parts 12 may be detachably provided to the receiving body 10. For example, separate or independent receiving parts 12 may be attached in whole or part to the receiving body 10 through a sticky material, such as Velcro™.

The fixing part 20 may be attached to the receiving body 10 to maintain the folded position of the receiving body 10.

The fixing part 20 may include coupling buttons 20 for holding the receiving body 10 in the folded position.

The coupling buttons 20 may include a first button 21 and a second button 23 attached on an inner side of the receiving body 10. The second button 23 is provided at a position where, when the receiving body 10 is in the folded position, the second button 23 may fit into the first button 21, facing the first button 21. According to an embodiment of the present invention, at least two or more first buttons 21 and at least two or more second buttons 23 may be provided. The coupling buttons 20 may include, but is not limited to, snap fastener (also called press stud, popper, snap or tich) that is a pair of interlocking discs, made out of a metal or plastic, to fasten clothing and for similar purposes. The coupling buttons 20 may enable easy and stable fastening of the folded receiving body 10.

Although an example in which the fixing part 20 includes the first button 21 and the second button 23 is described, embodiments of the present invention are not limited. For example, zippers (not shown) may be attached to opposite edges of the folded receiving body 10 to hold the receiving body 10 in the folded position.

The receiving body 10 may include the coupling part that is coupled to a target for coupling, e.g., the carrier 11.

The coupling part may include the insertion hole 14*a*, the projecting pad 14*b*, and the coupling pad 14*c*. The insertion hole 14*a* is formed through the receiving body 10. The coupling member 16 to be coupled to the target for coupling is inserted through the insertion hole 14*a*. The projecting pad 14*b* is attached to a first side surface of the receiving body 10. An end of the coupling member 16 passes through the insertion hole 14*a* and is fixed to the projecting pad 14*b*. The coupling pad 14*c* is attached to a second side surface of the receiving body 10. A hanging hook coupled to the target for coupling is fixed to the coupling pad 14*c*.

The insertion hole 14*a* may be formed at an inner side of the receiving body 10 while the receiving body 10 is in the folded position. Specifically, the insertion hole 14*a* may be formed at a position adjacent to an edge of the receiving body 10 when the receiving body 10 is in the folded position. To that end, the receiving body 10 may be formed so that a first portion thereof, which has the insertion hole 14*a*, is longer than a second portion thereof which does not have the insertion hole 14*a* when the receiving body 10 is in the folded position. The first portion and the second portion of the receiving body 10 may refer to two folded portions, respectively, of the receiving body 10. The coupling member 16 for hanging to the user's neck may be inserted through the insertion hole 14*a*. An end of the coupling member 16 may be inserted and passes through the insertion hole 14*a* and may then be fixed to the projecting pad 14*b*.

The projecting pad 14*b* is attached to a side of the receiving body 10. An end of the coupling member 16 may be fixed to the projecting pad 14*b*. The projecting pad 14*b* may be formed of substantially the same material as the receiving body 10. Alternatively, the projecting pad 14*b* may be formed of a stronger material than the receiving body 10. For example, the projecting pad 14*b* may be formed of a leather material stronger than the receiving body 10. The fixing button 14*d* may be attached to the projecting pad 14*b* to fix the coupling member 16. The coupling member 16 may be detachably fixed to the fixing button 14*d*. When the users hangs the carrier wallet 100 to his neck, the coupling member 16 may be fixed to the projecting pad 14*b*. When the user hangs the carrier wallet 100 to the carrier 11, the coupling member 16 may be removed.

The coupling pad 14*c* may be attached to another side of the receiving body 10. The hanging hook 18 may be connected to the coupling pad 14*c*. The coupling pad 14*c* may be attached to the receiving body 10 so that both edges thereof are fixed to the receiving body 10 while a central portion thereof is separated from the surface of the receiving body 10.

The hanging hook 18 may be inserted through a space between the coupling pad 14*c* and the receiving body 10, allowing the receiving body 10 to be fixed to the handle 11*b* of the carrier 11.

Specifically, the hanging hook 18 may include a hanging bar 18*a* fixed to the handle 11*b* of the carrier 11 and a hook part 18*b* connected to an end of the hanging bar 18*a*. As the hook part 18*b* is inserted through the space between the receiving body 10 and the coupling pad 14*c* and is fastened, the carrier wallet 100 may be stably fixed to the handle 11*b* of the carrier.

According to an embodiment of the present invention, two hanging hooks 18 may be provided to be spaced apart from each other at a predetermined distance, and the two hanging hooks 18 respectively may be put in through two corresponding spaces between the coupling pad 14*c* and the surface of the receiving body 10 to hang the carrier wallet 100 as shown in FIG. 2.

Figure 6:
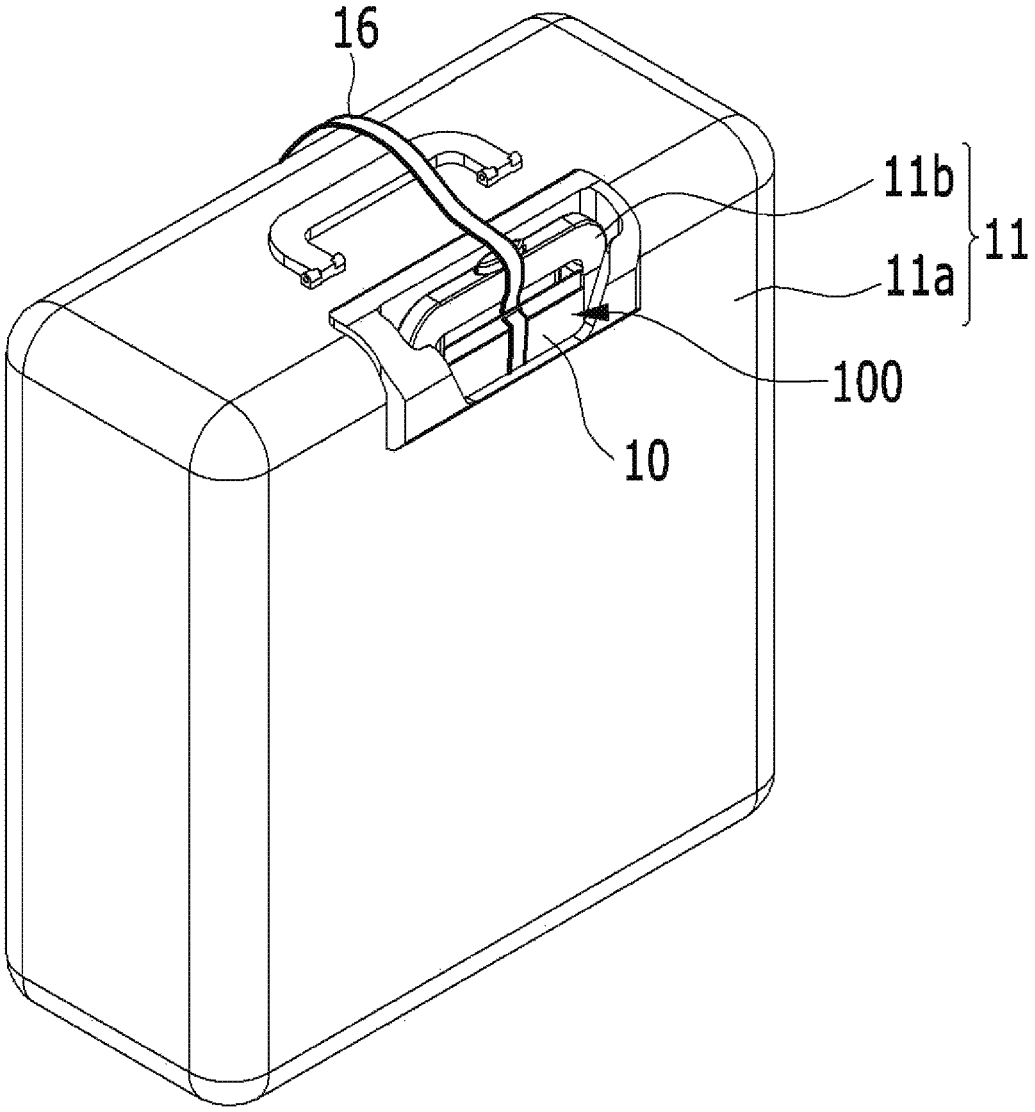
FIG. 6 is a perspective view illustrating the wallet for a carrier of FIG. 5, with the handle of the carrier pulled in the carrier, according to an embodiment of the present invention.
Figure 7:
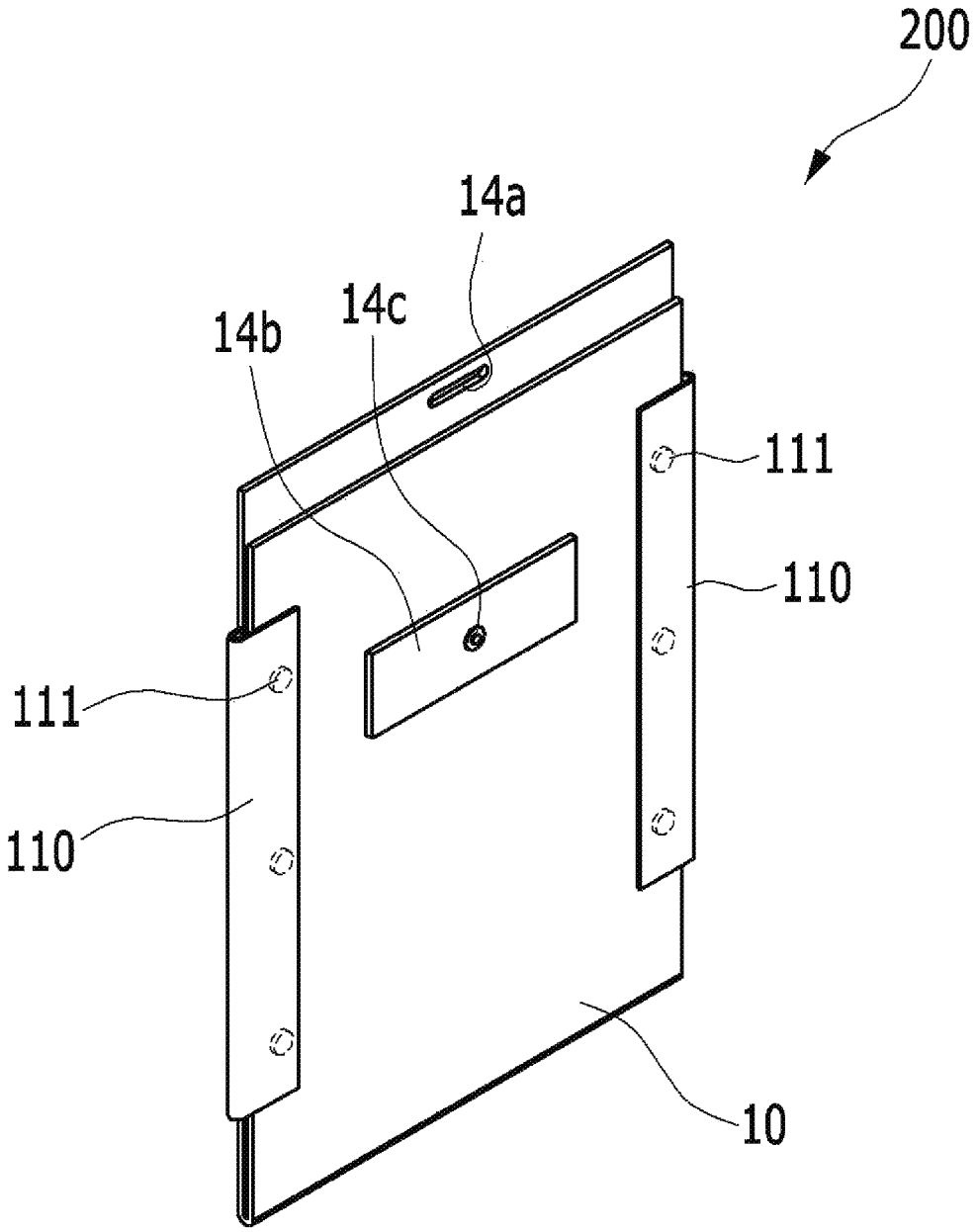
FIG. 7 is a perspective view illustrating a wallet for a carrier according to an embodiment of the present invention.

When the handle 11*b* is pulled down in the inside of the carrier 11, with the carrier wallet 100 coupled to the handle 11*b* of the carrier 11, the carrier wallet 100, together with the handle 11*b* may be received in the inside of the carrier 11 as shown in FIGS. 6 and 7.

FIG. 6 is a perspective view illustrating the wallet for a carrier of FIG. 5, with the handle of the carrier pulled in the carrier, according to an embodiment of the present invention.

As described above, when the handle 11*b* is pulled down in the inside of the carrier 11, with the carrier wallet 100 coupled to the handle 11*b* of the carrier 11, the carrier wallet 100, together with the handle 11*b* may be received in the inside of the carrier 11 as shown in FIGS. 6 and 7. Accordingly, the carrier wallet 100 may be safely received in the inside of the carrier 11, preventing it from being stolen.

Figure 8:
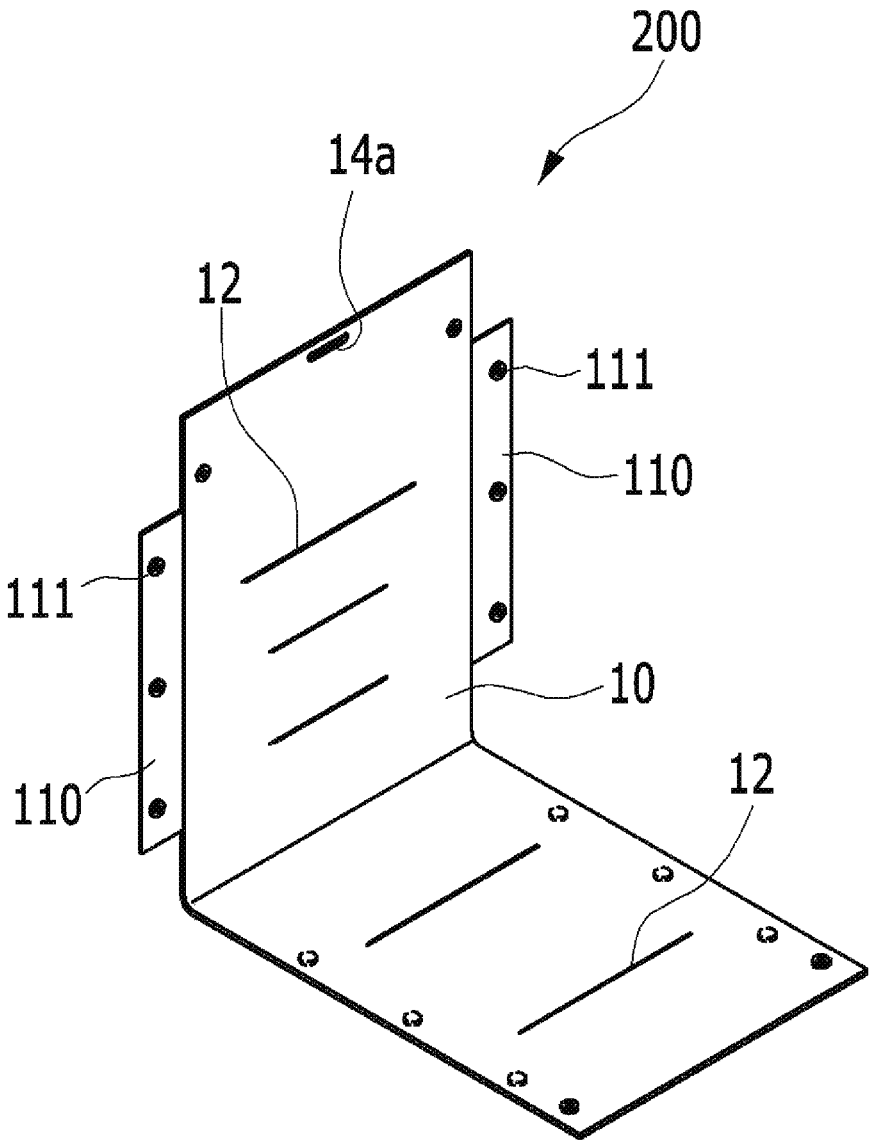
FIG. 8 is a perspective view illustrating the wallet for a carrier of FIG. 7 that is opened according to an embodiment of the present invention.

FIG. 7 is a perspective view illustrating a wallet for a carrier according to an embodiment of the present invention. FIG. 8 is a perspective view illustrating the wallet for a carrier of FIG. 7 that is opened according to an embodiment of the present invention.

Figure 9:
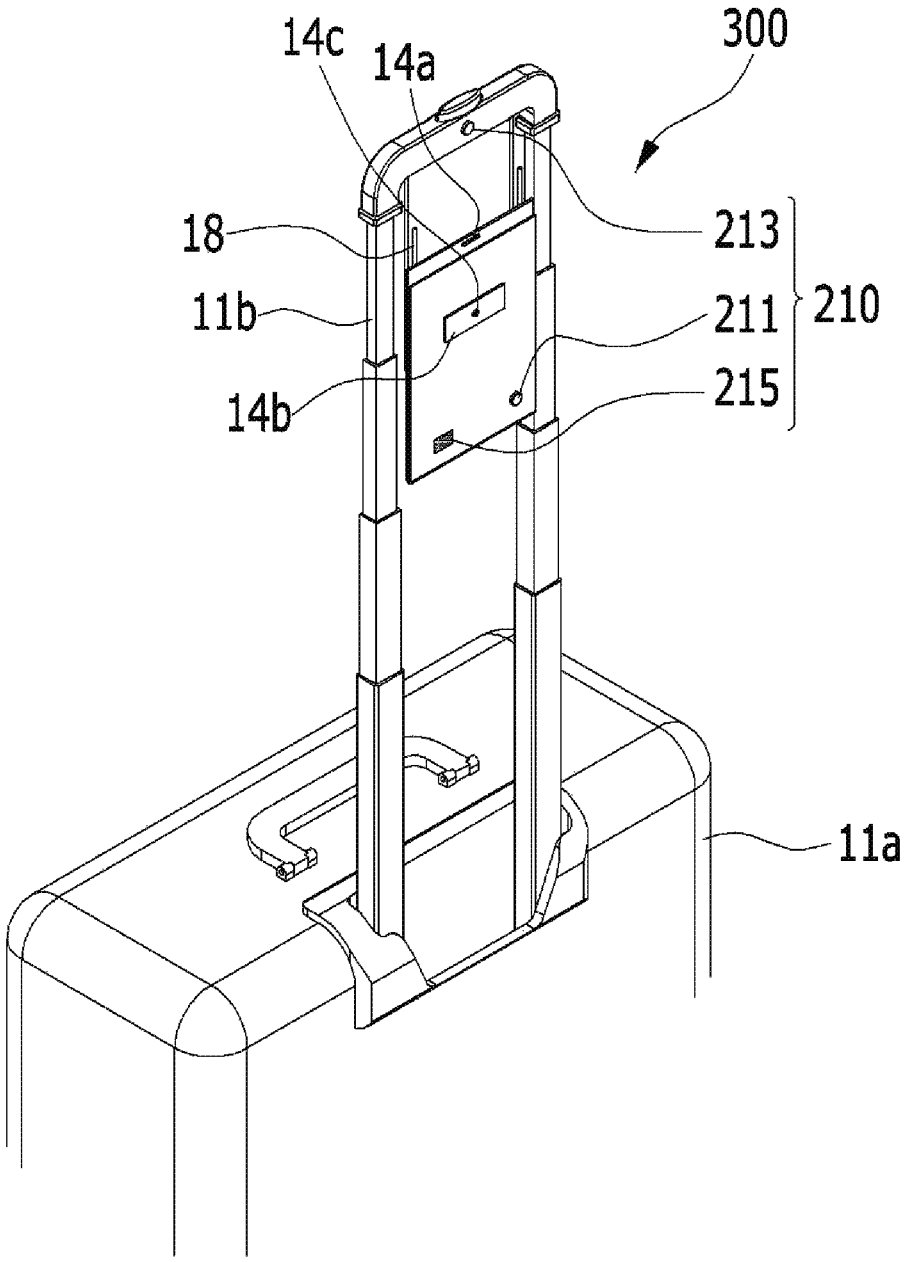
FIG. 9 is a perspective view illustrating a wallet for a carrier attached to a handle of the carrier according to an embodiment of the present invention.

Referring to FIGS. 8 and 9, the carrier wallet 200 may include a covering member 110 covering both side surfaces of the carrier wallet 200.

The covering member 110 may cover the side surfaces of the receiving body 10, with the receiving body 10 is in the folded position, preventing the received items 12*a* from being lost or stolen.

Specifically, a portion of the covering member 110 may be attached to an edge of the first portion of the folded receiving body 10, and another portion of the covering member 110 may be attached to an edge of the second portion of the folded receiving body 10. The covering member 110 may include a plurality of buttons 111 formed along a longitudinal direction of the covering member 11 to cover and fasten the side surfaces of the receiving body 10.

As described above, the side surfaces of the folded receiving body 10 may be covered by the covering member 110 while the received items 12*a* are put in the receiving body 10, preventing the received items 12*a* from being lost or stolen.

FIG. 9 is a perspective view illustrating a wallet for a carrier attached to a handle of the carrier according to an embodiment of the present invention.

Referring to FIG. 9, the carrier wallet 300 may include an alarming device 210 that may send an alarm when the carrier wallet 300 is separated away from the carrier 11 at a predetermined distance or more.

The alarming device 210 may include a first sensor 213 attached to the carrier 11, a second sensor 211 installed in the receiving body 10 to sense being separated from the first sensor 213 at a predetermined distance or more, and an alarming unit 215 that generates an alarm when the second sensor 211 is separated from the first sensor 213 at the predetermined distance or more.

Accordingly, when the carrier wallet 300 is off from the carrier 11, e.g., when the carrier wallet 300 is stolen and detached from the carrier 11, the alarming device 210 may alarm the user.

For example, when the carrier wallet 300 is stolen, and the first sensor 213 is separated from the second sensor 211 at a predetermined distance, the alarming unit 215 may send an alarm to the user. The alarming unit 215 may include, e.g., an alarming speaker. For example, when the carrier wallet 300 is separated from the carrier 11 at a predetermined distance, the alarming speaker may send out an alarming sound to alarm the user, preventing the carrier wallet 300 from being stolen.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A wallet for a carrier, comprising:

a receiving body formed to be foldable along a direction of a length thereof and having a plurality of receiving parts at a side surface thereof;

a fixing part attached to the receiving body to hold the receiving body in a folded position; and a coupling part attached to a side of the receiving body and having a coupling member fixed thereto, the coupling member coupled to a certain part of the carrier, wherein the coupling part comprises:

an insertion hole formed through the receiving body, the coupling member inserted through the insertion hole;

a projecting pad attached to a side surface of the receiving body, an end of the coupling member passing through the insertion hole and fixed to the projecting pad; and a coupling pad attached to another side surface of the receiving body, a hanging hook connected to the coupling pad.

2. The wallet for the carrier of claim 1, wherein the fixing part is a coupling button fixing the folded position of the receiving body.

3. The wallet for the carrier of claim 1, wherein a covering member is attached to the receiving body to cover a side surface of the folded receiving body.

4. The wallet for the carrier of claim 1, wherein an alarming device is installed in the receiving body to generate an alarm when the wallet is separated from the certain part of the carrier by a predetermined distance or more, and wherein the alarming device comprises a first sensor attached to the certain part of the carrier, a second sensor installed in the receiving body to sense being separated from the first sensor by a predetermined distance or more, and an alarming unit generating an alarm when the second sensor is separated from the first sensor by the predetermined distance or more.

* * * * *